US009451368B2

(12) United States Patent
Mazanec

(10) Patent No.: US 9,451,368 B2
(45) Date of Patent: Sep. 20, 2016

(54) FEEDBACK SCAN FOR HEARING AID

(75) Inventor: Paul R. Mazanec, Blaine, MN (US)

(73) Assignee: ENVOY MEDICAL CORPORATION, St. Paul, MN (US)

( * ) Notice: Subject to any disclaimer, the term of this patent is extended or adjusted under 35 U.S.C. 154(b) by 745 days.

(21) Appl. No.: 13/444,262

(22) Filed: Apr. 11, 2012

(65) Prior Publication Data

US 2013/0272531 A1 Oct. 17, 2013

(51) Int. Cl.
*H04R 29/00* (2006.01)
*H04R 25/00* (2006.01)

(52) U.S. Cl.
CPC ..... *H04R 25/305* (2013.01); *H04R 25/45* (2013.01); *H04R 25/30* (2013.01); *H04R 25/70* (2013.01)

(58) Field of Classification Search
CPC ..... G01M 7/022
USPC ..... 381/60, 312, 313
See application file for complete search history.

(56) References Cited

U.S. PATENT DOCUMENTS 3,394,227 A * 7/1968 Hopengarten et al. ..... 381/28
3,600,934 A * 8/1971 Hendrix et al. ..... 73/570
4,049,930 A * 9/1977 Fletcher et al. ..... 381/60
4,184,205 A * 1/1980 Morrow ..... 702/34
RE31,750 E * 11/1984 Morrow ..... 702/34
5,124,626 A * 6/1992 Thoen ..... 318/610
5,192,917 A * 3/1993 Schweigert et al. ..... 327/50
5,467,775 A * 11/1995 Callahan et al. ..... 600/528
5,703,446 A * 12/1997 Doan ..... 318/119
5,852,793 A * 12/1998 Board et al. ..... 702/56
6,134,329 A 10/2000 Gao et al.
7,197,152 B2 * 3/2007 Miller et al. ..... 381/326
7,333,618 B2 * 2/2008 Shuttleworth et al. ..... 381/57
7,463,745 B2 * 12/2008 Miller, III ..... 381/318
7,873,173 B2 * 1/2011 Inoue et al. ..... 381/71.4
8,196,470 B2 * 6/2012 Gross et al. ..... 73/585
8,325,931 B2 * 12/2012 Howard et al. ..... 381/58
8,520,862 B2 * 8/2013 Scholz ..... 381/97
8,600,067 B2 * 12/2013 Usher et al. ..... 381/58
2002/0176584 A1 * 11/2002 Kates ..... A61B 5/12 381/60
2003/0088346 A1 * 5/2003 Calkins et al. ..... 701/29
2004/0037428 A1 * 2/2004 Keller ..... A61B 5/121 381/60
2005/0063552 A1 * 3/2005 Shuttleworth et al. ..... 381/57
2005/0226447 A1 * 10/2005 Miller, III ..... 381/318
2006/0056642 A1 * 3/2006 Inoue et al. ..... 381/71.11
2007/0167671 A1 * 7/2007 Miller, III ..... 600/25
2007/0223733 A1 * 9/2007 Shuttleworth et al. ..... 381/94.1
2008/0069365 A1 * 3/2008 Shuttleworth et al. ..... 381/57
2009/0304204 A1 * 12/2009 Bieber et al. ..... 381/98
2011/0026723 A1 * 2/2011 Inoue ..... 381/71.4
2011/0075854 A1 * 3/2011 Sakamoto et al. ..... 381/71.1
2011/0280410 A1 * 11/2011 Matono et al. ..... 381/71.1
2013/0272531 A1 * 10/2013 Mazanec ..... 381/60

* cited by examiner

*Primary Examiner* — Amir Etesam
(74) *Attorney, Agent, or Firm* — Seagate, Tufte & Wickhem LLP

(57) ABSTRACT

A hearing aid is disclosed, having the ability to generate its own open-loop feedback scan of amplitude (as gain or attenuation) and phase, as a function of frequency. The hearing aid has a sensor that receives ambient sound from near a patient, and a driver that stimulates the anatomy of the patient. The hearing aid has an operational mode in which the driver stimulates the anatomy of the patient in response to the sound received at the sensor. The hearing aid has a test mode in which a test frequency is stepped through a predetermined range of frequencies. At each test frequency, the driver is driven with a sinusoidal driver signal at the test frequency, the sensor detects a sinusoidal sensor signal at the test frequency, and a comparison of the sensor signal to the driver signal produces an amplitude (gain or attenuation) and a phase for the test frequency.

12 Claims, 4 Drawing Sheets

FEEDBACK SCAN FOR HEARING AID

TECHNICAL FIELD

The present invention pertains to hearing aids, and methods for manufacturing and using such hearing aids.

BACKGROUND

Hearing restoration or compensation devices, commonly known as hearing aids, provide a tremendous benefit to a patient with congenital hearing loss or whose hearing has deteriorated due to age, genetics, illness, or injury. There is a wide variety of commercially available devices that can be worn externally or can be implanted within the body of the patient.

In general, it is desirable to provide a high level of gain in the device, so that ambient sound may be significantly amplified for the patient. However, if the gain is too high, some sound may leak from the output speaker to the input microphone, and the device may produce acoustic feedback. Acoustic feedback is a highly undesirable condition, and can lead to a loud squealing noise heard by the patient.

Accordingly, there exists a need for a diagnostic tool that can characterize the performance of the device, so that the gain may be set at a level below the threshold at which acoustic feedback occurs. In addition, for implantable devices, the characterization may be repeated over an extended period of time, and may help diagnose tissue growth or fluid in the middle ear.

BRIEF SUMMARY

An embodiment is a hearing aid, including: a sensor that receives ambient sound from around a patient; and a driver that stimulates the anatomy of the patient. The hearing aid has an operational mode in which the driver stimulates the anatomy of the patient in response to the sound received at the sensor. The hearing aid has a test mode in which a test frequency is stepped through a predetermined range of frequencies. At each test frequency, the driver is driven with a sinusoidal driver signal at the test frequency, the sensor detects a sinusoidal sensor signal at the test frequency, and a comparison of the sensor signal to the driver signal produces an amplitude and a phase for the test frequency.

Another embodiment is a device for restoring the hearing of a patient, including: a sensor for converting ambient sound around the patient into a corresponding input electrical signal; an audio processing unit for receiving the input electrical signal and producing an output electric signal; and a driver for converting the output electrical signal into a stimulation signal that can be received by the anatomy of the patient. The audio processing unit includes a test mode during which the audio processing unit drives the driver with a sinusoidal driver signal at a predetermined frequency, receives through the sensor a sinusoidal sensor signal at the predetermined frequency, compares the sensor signal to the driver signal, and determines a feedback gain and a feedback phase shift at the predetermined frequency from the compared driver and sensor signals.

A further embodiment is a device for restoring the hearing of a patient, comprising: a sensor for converting ambient sound around the patient into a corresponding input electrical signal; an audio processing unit for receiving the input electrical signal and producing an output electric signal; and a driver for converting the output electrical signal into a stimulation signal that can be received by the anatomy of the patient. The audio processing unit includes a test mode during which the audio processing unit drives the driver with a sinusoidal driver signal at a predetermined frequency, receives through the sensor a sinusoidal sensor signal at the predetermined frequency, and samples and stores at least four voltage levels each for the sensor and driver signals. The voltage levels are sampled at intervals that are spaced apart by one-fourth of an oscillation period at the predetermined frequency.

The above summary of some embodiments is not intended to describe each disclosed embodiment or every implementation of the present invention. The Figures, and Detailed Description, which follow, more particularly exemplify these embodiments.

BRIEF DESCRIPTION OF THE DRAWINGS

The invention may be more completely understood in consideration of the following detailed description of various embodiments of the invention in connection with the accompanying drawings, in which.

Figure 1:
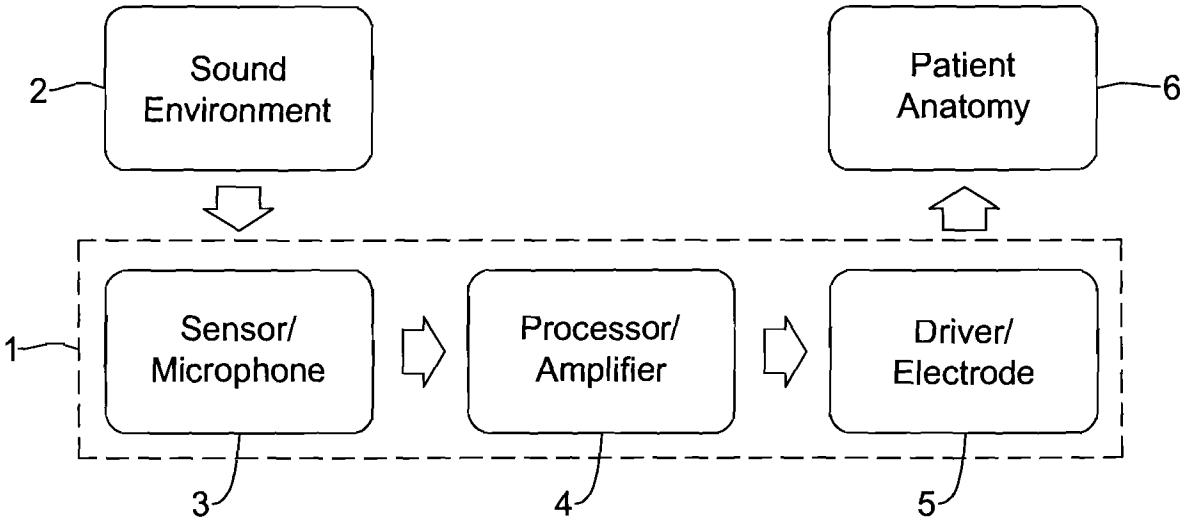
FIG. 1 is a block diagram of an implantable hearing restoration device.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION

For the purposes of this document, the term "hearing aid" is intended to mean any instrument or device designed for or represented as aiding, improving or compensating for defective human hearing and any parts, attachments or accessories of such an instrument or device.

A hearing aid is disclosed, having the ability to generate its own open-loop feedback scan of amplitude (as gain or attenuation) and phase, as a function of frequency. The hearing aid has a sensor that receives ambient sound from near a patient, and a driver that stimulates the anatomy of the patient. The hearing aid has an operational mode in which the driver stimulates the anatomy of the patient in response to the sound received at the sensor. The hearing aid has a test mode in which a test frequency is stepped through a predetermined range of frequencies. At each test frequency, the driver is driven with a sinusoidal driver signal at the test frequency, the sensor detects a sinusoidal sensor signal at the test frequency, and a comparison of the sensor signal to the driver signal produces an amplitude (gain or attenuation) and a phase for the test frequency.

The above paragraph is merely a general summary, and should not be construed as limiting in any way. More detail is provided in the figures and in the text that follows.

FIG. 1 is a block diagram of an implantable hearing restoration device 1, with arrows that trace the flow of acoustic signals. The acoustic signals flow from a sound environment 2, to an implantable hearing restoration device 1, to a patient anatomy 6.

The sound environment 2 may be the acoustic environment in which the patient and hearing device 1 exist, such as a quiet office, a busy street, or a soundproof booth that may be used for audiometric testing. The sound environment 2 may create sounds that are within the typical pressure and frequency range that a human with normal hearing can perceive. In general, a typical frequency range for normal human hearing may be between 20 Hz and 20 kHz, although the high-frequency edge of this range typically decreases with age. Note that the sound environment 2 may produce acoustic signals outside the frequency range of human hearing as well, although the implantable hearing restoration device 1 may be largely unaffected by these signals. Sounds produced by the sound environment 2 arrive at the implantable hearing restoration device 1 in the form of acoustic pressure waves.

The implantable hearing restoration device 1 may include three general units, including a sensor 3 or microphone 3, a processor 4 or amplifier 4, and a driver 5 or electrode 5. The driver 5 or electrode 5 may also be referred to as a speaker.

The sensor 3 may be an element or transducer that converts mechanical or acoustic energy into an electrical signal, such as a microphone or piezoelectric sensor. The sensor 3 receives the sound produced by the sound environment 2 and converts it into an input electrical signal. For the purposes of this document, it is assumed that the input electrical signal may be generated in a known manner.

The processor 4 processes the input electrical signal from the sensor 3, and may amplify, filter and/or apply other linear and/or non-linear algorithms to the input electrical signal. The processor 4 produces an output electrical signal and sends it to the driver 5. In general, much of the remainder of this document is directed to particular processing performed by the processor 4, and there is much more detail concerning the processor 4 in the text that follows.

The driver 5 receives the output electrical signal from the processor 4 and converts it into a stimulation signal that can be received by the patient anatomy 6. Depending on the type of implantable hearing restoration device 1, such as a cochlear implant or middle ear device, the stimulation signal may be acoustic, mechanical and/or electrical in nature. For the purposes of this document, it is assumed that the stimulation signal may be received in a known manner.

The implantable hearing restoration device 1 can characterize the feedback network between the driver 5 and the sensor 3. Specifically, the implantable hearing restoration device 1 may characterize the relationship between the input electrical signal received from the sensor 3 and the output electrical signal sent to the driver 5. If there is sufficiently high gain between the input and output electrical signals, then there may be conditions at which the device 1 can produce undesirable feedback. A device said to be "in feedback" may be unstable and may be in oscillation, usually at one particular frequency. Feedback in a hearing aid is highly undesirable.

The physical cause of feedback may vary, depending on the type of hearing aid. For an externally worn hearing aid, feedback may be caused by acoustic energy leaking back from the output speaker to the input microphone and consequently being amplified repeatedly. This causes the amplifier or processor to oscillate and causes the patient to hear a loud squealing noise. For an implantable device, such as the device 1 shown in FIG. 1, feedback may be caused by vibrations coupling back into the sensor through bone in the patient's head, through fluid residing in the middle ear, and/or tissue that has grown since the device was implanted.

Characterization of the feedback network may provide the clinician with a value of the maximum gain that the device 1 could provide before feedback or oscillation occurs. In general, such a value is beneficial, in that it allows the clinician to increase the gain as much as possible without risking feedback. In addition, if such a characterization were repeated over time, a clinician could use the results over time to help diagnose physiological changes such as tissue growth or fluid in the middle ear.

Figure 2:
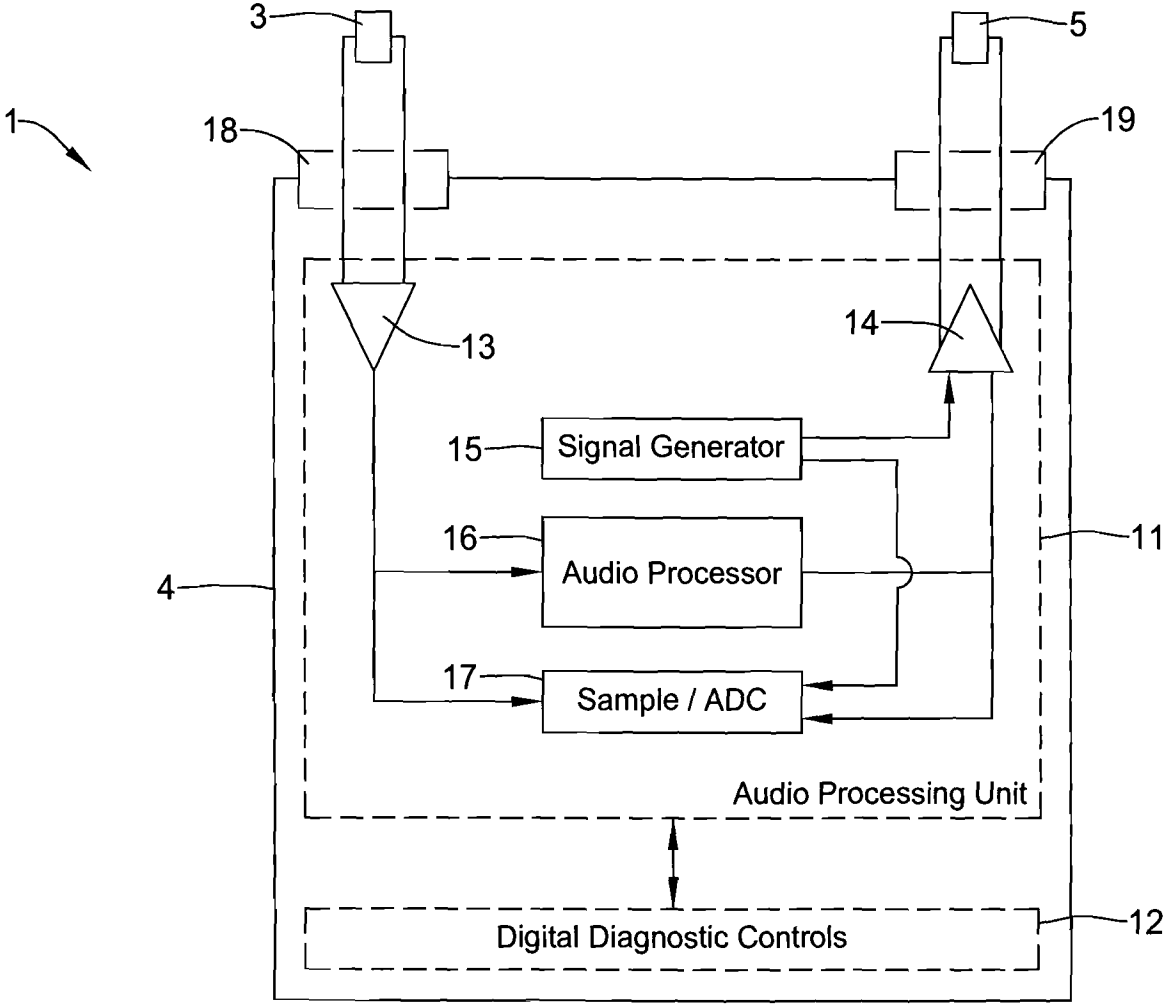
FIG. 2 is a schematic drawing of a sample implantable hearing restoration device.

FIG. 2 is a schematic drawing of a sample implantable hearing restoration device 1. In particular, the sample device 1 shows particular modules and elements that perform particular functions. It will be understood by one of ordinary skill in the art that the configuration of FIG. 2 is merely an example, and that other modules and elements may be used to perform the particular functions noted in detail below. In addition, although both the sensor 3 and the driver 5 are shown in the example of FIG. 2 as being electrically capacitive in nature, it will be understood that other sensors and drivers may be used that need not be based on capacitance.

This paragraph describes the elements and components used in the day-to-day operation of the device 1. The sensor 3 electrically connects to the processor 4 through a transducer connection 18. The electrical signal produced by the sensor 3 enters an input amplifier 13. During normal use, the signal from the input amplifier 13 enters an audio processor 16, the signal from the audio processor 16 feeds an output amplifier 14, which in turn connects electrically through a transducer connection 19 to the driver 5. Note that the day-to-day operation of the device 1 may use all-analog processing of the sound, rather than conversion to digital, processing in the digital domain, and conversion back to analog. The input amplifier 13, the audio processor 16 and the output amplifier 14 may be grouped collectively as an audio processing unit 11, although the individual components need not be physically grouped together in the same location on a circuit board or integrated circuit. The processor 4 includes a set of digital diagnostic controls 12 that can control the analog elements, and can control properties such as the gain, equalization, compression/limiting, and so forth.

Two additional components that may be used to analyze the feedback network are a signal generator 15 and a sampler/analog-to-digital converter 17, both of which may be grouped with the audio processing unit 11.

The signal generator 15 may generate a sine wave of a known frequency and amplitude. The frequency and amplitude may be controlled by the digital diagnostic controls 12. The sinusoidal output from the signal generator 15 may be fed into the output amplifier 14, which in turn, drives the driver 5. The driver 5 stimulates the anatomy of the patient, and a small portion of the sinusoidal energy may be picked up by the sensor 3. The sinusoidal signal received by the sensor 3 may be amplified by the input amplifier 13. The output from the input amplifier 13 may also feed the sampler/analog-to-digital converter 17, in addition to feeding the audio processor 16. The sampler/analog-to-digital converter 17 may sense an amplitude and a phase for the sinusoidal signal, and may store the sensed amplitude and phase in memory within the audio processing unit 11 or external to the audio processing unit 11. The digital diagnostic controls may then change the sine wave frequency of the signal generator 15, and the process may repeat. The process is then repeated with sufficient resolution in frequency, over a sufficiently large range of frequencies, resulting in the device having acquired a set of measured amplitudes and phases as a function of frequency.

Figure 3:
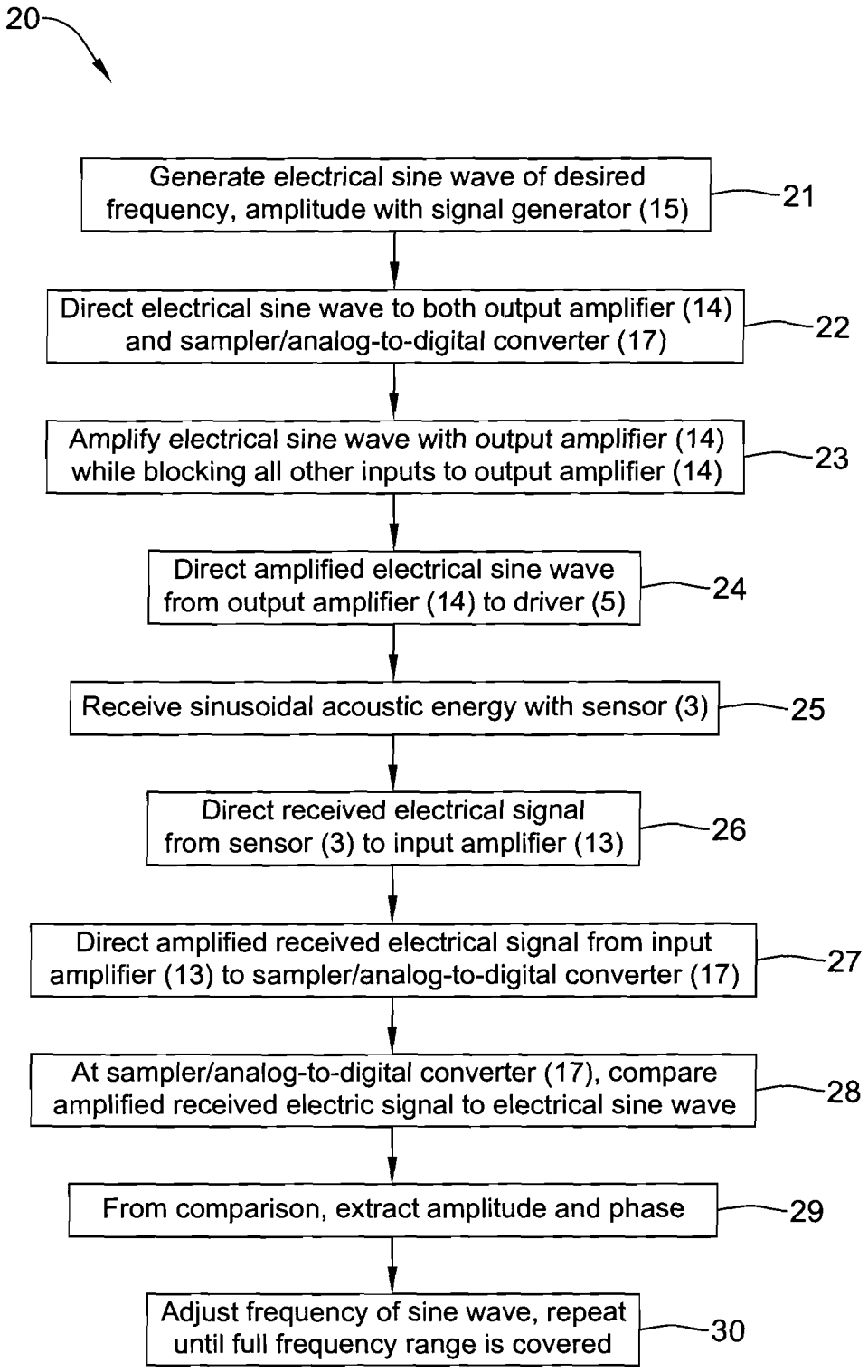
FIG. 3 is a flow chart of the method of operation for the device of FIG. 2.

FIG. 3 is an example flow chart of the method of operation 20 for the device 1 of FIG. 2. In step 21, the signal generator 15 generates an electrical sine wave of a predetermined frequency. In step 22, the signal generator 15 directs the electrical sine wave to both the output amplifier 14 and the sampler/analog-to-digital converter 17. In step 23, the output amplifier 14 amplifies the electrical sine wave while blocking all other inputs to output amplifier 14. In step 24, the output amplifier 14 directs the amplified electrical sine wave to the driver 5. Upon leaving the driver 5, the sine wave propagates as sinusoidal acoustic energy within the anatomy of the patient. In step 25, the sensor 3 receives the sinusoidal acoustic energy propagating within the anatomy of the patient. In step 26, the sensor 3 generates a received electrical signal from the received sinusoidal acoustic energy and directs it to the input amplifier 13. In step 27, the input amplifier 13 directs the amplified received electric signal to the sampler/analog-to-digital converter 17. In step 28, at the sampler/analog-to-digital converter 17, the amplified received electric signal is compared to the electrical sine wave. In step 29, from the comparison, the amplitude and phase are extracted. Note that this is the amplitude and phase between the driver 5 and the sensor 3, where the amplitude drop from the driver 5 to the sensor 3 is expected to be greater than roughly 65 dB. In step 30, the signal generator 15 adjusts the frequency of the electrical sine wave, and, optionally, the amplitude of the electrical sine wave as well. In some cases, the increment of frequency is predetermined to have sufficient resolution in the frequency domain. Steps 21-29 are then repeated until the full frequency range is covered.

Alternatively, at step 29, the device 1 may instead store several sampled values from the electrical sine wave and the amplified received electrical signal, the samples being taken at predetermined times. Once all the frequencies are swept, the device may then use all the stored sample values to determine the amplitude and phase at each frequency. In other words, the amplitude and phase may be calculated for each frequency as the data is taken, as is drawn in FIG. 3, or may alternatively be calculated all at once after all the data has been taken. In some cases, the stored values may be exported to a separate device, such as a module external to the patient, and the amplitudes and phases are calculated from the stored values on said external device or another external device.

It is instructive to work through some numbers, which may serve as rough guidelines for the requirements on the sampler/analog-to-digital converter 17. Typical patients having moderate to severe hearing loss may have hearing thresholds of up to 70 dB to 95 dB below that of someone with normal hearing. As a result, the hearing devices designed to treat moderate to severe hearing loss should be capable of providing 70 dB to 95 dB of gain. This, in turn, implies that the feedback network should have a gain of no more than −95 dB, or the device will go into oscillation (i.e. feedback) before reaching maximum gain. Therefore, the sampler/analog-to-digital converter 17 should be able to resolve signals that are about 100 dB quieter than that of the test signal being output by the driver 5.

Preferably, the feedback characterization may have high precision over a large dynamic range, may capture both magnitude and phase information, and may be performed quickly to minimize time for the patient and the clinician. We present below an example of a particularly fast way of extracting the measured amplitude and phase from the device 1 shown in FIG. 2. It will be understood by one of ordinary skill in the art that this is merely an example, and that other suitable ways of extracting the measured amplitude and phase may be used as well.

Once a frequency has been selected for the signal generator 15, and an amplitude has been selected (preferably as large as possible to maximize the signal-to-noise ratio), the signal generator 15 may begin outputting a sine wave with the selected frequency and amplitude. After a short time, typically a few oscillation periods, the signal generator 15 has settled into a steady-state oscillation having a relatively stable amplitude and being relatively free from transients.

The value of the frequency is fed to the sampler/analog-to-digital converter 17, so that the sampler/analog-to-digital converter 17 may sample signal values at specific time intervals that depend on the frequency. Specifically, for each frequency, the sampler/analog-to-digital converter 17 samples four values from both the signal generator 15 (representing the driver signal) and the input amplifier 13 (representing the sensor signal). The four values are taken at intervals of 90° of phase, or one-fourth of a full rotational period or cycle. The driver signal and the sensor signal are sampled at the same time.

Figure 4:
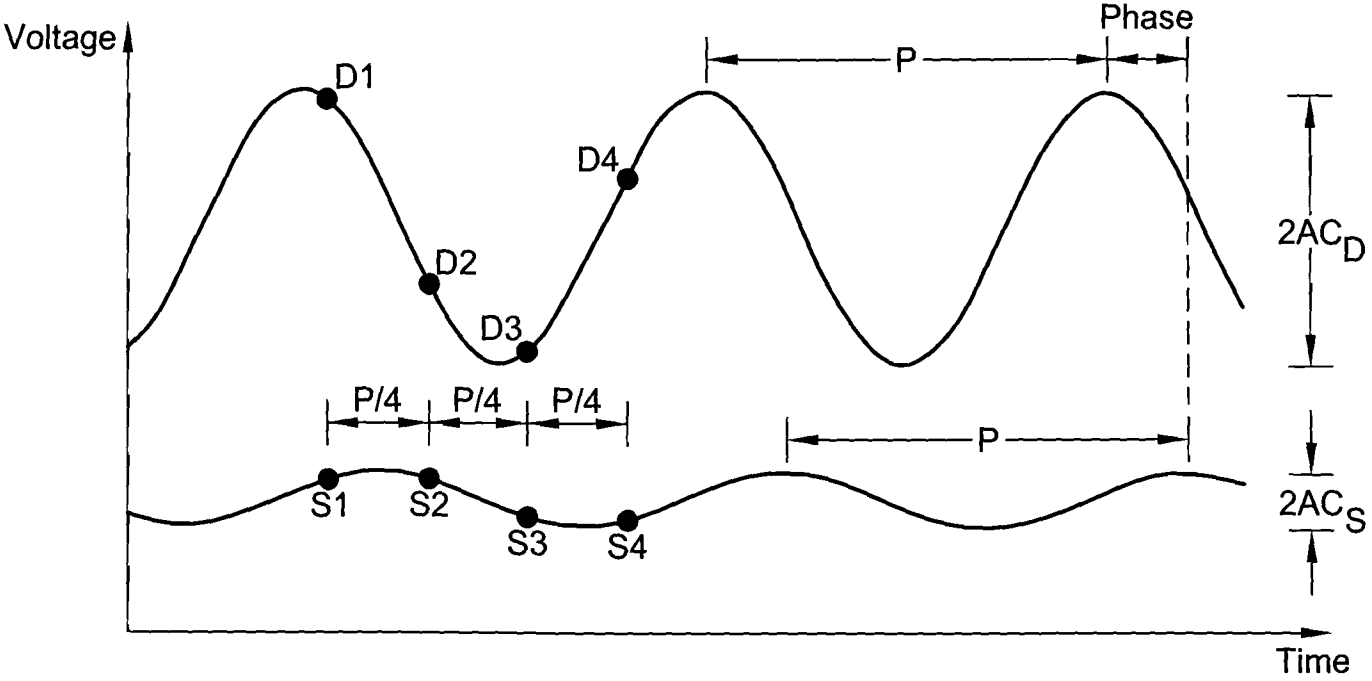
FIG. 4 is a plot of the driver signal voltage (top) and the sensor signal voltage (bottom) versus time.

FIG. 4 is an example plot of the driver signal voltage (top) and the sensor signal voltage (bottom) versus time. The period of both oscillatory voltages is denoted as "P", which mathematically is the inverse of the oscillation frequency. There is a phase shift between the driver and sensor signals, which is one of the quantities to be calculated. There is a peak-to-valley voltage of the driver signal, denoted as "$2AC_D$", which is an intermediate quantity to be calculated. Note that the peak-to-valley voltage is an AC component to the voltage; there is also a DC offset to the voltage not shown explicitly in FIG. 4. Similarly, the peak-to-valley voltage of the sensor signal is denoted as "$2AC_S$", which is also an intermediate quantity to be calculated. The gain of the system is one of the useful quantities to be calculated, and is given by the ratio of $2AC_S/2AC_D$.

For the purposes of nomenclature, the four time values are designated as "1", "2", "3" and "4", the driver signal is designated as "D", and the sensor signal is designated as "S". The four measured driver signal voltages are then "D1", "D2", "D3" and "D4", and the four measured sensor signal voltages are then "S1", "S2", "S3" and "S4". D1 and S1 are measured at same instant, D2 and S2 are measured at the same instant one-fourth of a period after D1 and S1, and so forth. For each frequency, the device 1 captures a total of eight signal voltages: D1, D2, D3, D4, S1, S2, S3 and S4.

Given the eight measured signal voltages, the two intermediate peak-to-valley voltages are given by:

$$2AC_S=[(S3-S1)^2+(S4-S2)^2]^{1/2}$$

$$2AC_D=[(D3-D1)^2+(D4-D2)^2]^{1/2}$$

The system gain (or attenuation) of the device 1 is given by $$\text{Gain}=2AC_S/2AC_D=[(S3-S1)^2+(S4-S2)^2]^{1/2}/[(D3-D1)^2+(D4-D2)^2]^{1/2}$$

The gain (or attenuation) may also be expressed in decibels, by taking 20 $\log_{10}$ of the above quantity.

The phase shift, in radians, between the driver and sensor signals is given by:

$$\text{Phase [radians]}=\text{a tan } 2[(D4-D2), (D3-D1)] \text{ a tan } 2[(S4-S2), (S3-S1)],$$

where "a tan 2" is a two-argument arctangent function. The phase in units of time may be found by multiplying the value in radians by the oscillation period P and dividing by $2\pi$.

As an alternative, the sampling times "1", "2", "3" and "4" need not be simultaneous for both the driver and sensor signals, since true simultaneity may be difficult for the sampler/analog-to-digital converter 17. Instead, the sampling times may be offset by a known amount, such as a fixed time delay or a fixed portion of a rotation period. For the purposes of this document, the term "simultaneous" is intended to cover both true simultaneity, and the cases where the sampling times are offset by a known, predetermined amount.

We summarize for this particular example. For a particular oscillation frequency sent to the signal generator 15, the period of oscillation is one divided by the oscillation frequency. The driver and sensor signals are simultaneously sampled at four instances, the instances being regularly spaced apart by one-fourth of an oscillation period. The sampled signals total eight sampled voltages. The gain and phase shift of the system are extracted through straightforward formulas from the eight sampled voltages. The process may be repeated over a range of frequencies, where the range may include the full range or a partial range of human hearing. This produces the gain and phase shift of the system, versus frequency, over a desired range of frequencies.

There may be potential advantages for extracting the amplitude and phase from the sinusoidal signals as described in the above example. For instance, the measurement can be very fast, requiring at most only a few periods of oscillation for each frequency. For a reasonable scan of the full range of human hearing, a full measurement may only take perhaps two or three seconds. In addition, the measured quantities require very little memory, merely eight stored voltage values for each frequency. Furthermore, the equations for extracting the amplitude and phase from the eight stored voltage values are robust, and do not include any undefined points at which division by zero occurs or accuracy is compromised. Finally, because the four time instances can start at any absolute time without affecting the results, there is no need for triggering from a particular starting point in the oscillations, such as a peak or a zero-crossing.

Note that the measured signal voltages noted in FIG. 4 and the equations presented above are just an example, and that other ways of extracting the amplitude and phase from the sinusoidal signals may also be used. Other techniques may also be used to improve the amplitude and phase extraction, such as increasing the sampling rate, which may help suppress any contributions from higher order harmonics.

There are many potential advantages to use of the device 1 for measuring the phase and amplitude, as a function of frequency, for all or a part of the range of human hearing. For instance, the feedback signal path may be isolated from the forward signal path. In addition, the measurement requires no additional equipment. Furthermore, the measurement technique can be implemented in both externally worn and in fully implantable hearing aids. Additionally, the measurement can be performed while wearing an ear plug to dramatically reduce error due to ambient noise. In addition, the measurement may be performed automatically by the device, and needs no additional calibration. Also, the measurement is not susceptible to variation in test equipment over time. Further, the measurement may be used to detect tissue growth and fluid in the middle ear. Finally, the measurement may be used to detect other issues with fully implantable systems.

For the following defined terms, these definitions shall be applied, unless a different definition is given in the claims or elsewhere in this specification.

All numeric values are herein assumed to be modified by the term "about," whether or not explicitly indicated. The term "about" generally refers to a range of numbers that one of skill in the art would consider equivalent to the recited value (i.e., having the same function or result). In many instances, the terms "about" may include numbers that are rounded to the nearest significant figure.

The recitation of numerical ranges by endpoints includes all numbers within that range (e.g. 1 to 5 includes 1, 1.5, 2, 2.75, 3, 3.80, 4, and 5).

As used in this specification and the appended claims, the singular forms "a," "an," and "the" include plural referents unless the content clearly dictates otherwise. As used in this specification and the appended claims, the term "or" is generally employed in its sense including "and/or" unless the content clearly dictates otherwise.

The preceding detailed description should be read with reference to the drawings in which similar elements in different drawings are numbered the same. The drawings, which are not necessarily to scale, depict illustrative embodiments and are not intended to limit the scope of the invention.

It should be understood that this disclosure is, in many respects, only illustrative. Changes may be made in details, particularly in matters of shape, size, and arrangement of steps without exceeding the scope of the invention. The invention's scope is, of course, defined in the language in which the appended claims are expressed.

What is claimed is:

1. A hearing aid, comprising:

a sensor that receives ambient sound from around a patient; and a driver that stimulates the anatomy of the patient;

wherein the hearing aid has an operational mode in which the driver stimulates the anatomy of the patient in response to the sound received at the sensor;

wherein the hearing aid has a test mode in which a test frequency is stepped through a predetermined range of frequencies; and wherein at each test frequency, the driver is driven with a sinusoidal driver signal at the test frequency, the sensor detects a sinusoidal sensor signal at the test frequency, and a comparison of the sensor signal to the driver signal produces an amplitude and a phase for the test frequency, wherein the sinusoidal driver signal and the sinusoidal sensor signal are sampled at intervals that are spaced apart by one-fourth of an oscillation period at the test frequency.

2. The hearing aid of claim 1, wherein four samples of the sinusoidal driver signal and four samples of the sinusoidal sensor signal are saved at each test frequency as voltage levels.

3. The hearing aid of claim 2, wherein the samples of the sinusoidal driver signal are offset in time from the samples of the sinusoidal sensor signal by a predetermined offset for each test frequency.

4. The hearing aid of claim 3, wherein the predetermined offset is zero for all test frequencies.

5. The hearing aid of claim 4, wherein for each test frequency:

the four samples of the sinusoidal driver signal are denoted as D1, D2, D3 and D4;

the four samples of the sinusoidal sensor signal are denoted as S1, S2, S3 and S4;

the system amplitude is given by:

$$[(S3-S1)^2+(S4-S2)^2]^{1/2}/[(D3-D1)^2+(D4-D2)^2]^{1/2};$$

and the system phase is given by:

$$\text{a tan } 2[(D4-D2), (D3-D1)]-\text{a tan } 2[(S4-S2), (S3-S1)].$$

6. The hearing aid of claim 3, wherein the predetermined offset is a constant time for all test frequencies.

7. The hearing aid of claim 3, wherein the predetermined offset is a constant phase for all test frequencies.

8. The hearing aid of claim 1, wherein the hearing aid is surgically implantable in the patient, is a cochlear device, or is a middle ear device.

9. A device for restoring the hearing of a patient, comprising:

a sensor for converting ambient sound around the patient into a corresponding input electrical signal;

an audio processing unit which receives the input electrical signal and produces an output electric signal; and a driver for converting the output electrical signal into a stimulation signal that can be received by an anatomy of the patient;

wherein the audio processing unit includes a test mode during which the audio processing unit drives the driver with a sinusoidal driver signal at a predetermined frequency, receives through the sensor a sinusoidal sensor signal at the predetermined frequency, and samples and stores at least four voltage levels each for the sensor and driver signals; and wherein the voltage levels are sampled at intervals that are spaced apart by one-fourth of an oscillation period at the predetermined frequency.

10. The device of claim 9, further comprising a module external to the patient for reading the stored at least four voltage levels each for the sensor and driver signals.

11. The device of claim 10, wherein the stored at least four voltage levels determine a feedback gain and a feedback phase shift at the predetermined frequency.

12. The device of claim 9, wherein the predetermined frequency is stepped in discrete increments over a predetermined frequency range.

* * * * *